US008052399B2

(12) United States Patent
Stemple et al.

(10) Patent No.: US 8,052,399 B2
(45) Date of Patent: Nov. 8, 2011

(54) PERISTALTIC PUMP

(75) Inventors: Jim Stemple, Marengo, IL (US); Andrew Frolov, Glenview, IL (US)

(73) Assignee: Cole-Parmer Instrument Company, Barrington, IL (US)

( * ) Notice: Subject to any disclaimer, the term of this patent is extended or adjusted under 35 U.S.C. 154(b) by 625 days.

(21) Appl. No.: 12/253,434

(22) Filed: Oct. 17, 2008

(65) Prior Publication Data

US 2009/0129944 A1 May 21, 2009

Related U.S. Application Data

(60) Provisional application No. 60/980,951, filed on Oct. 18, 2007.

(51) Int. Cl.
*F04B 43/12* (2006.01)

(52) U.S. Cl. ..... 417/53; 417/476

(58) Field of Classification Search ..... 417/477.2, 417/477.11, 474–476, 477.1, 477.3, 477.4, 417/477.5, 477.6, 477.7, 477.8, 477.9, 477.12, 417/477.13, 477.14, 478, 53; 604/225, 66–67, 604/151, 203.14, 203.12, 6.14
See application file for complete search history.

(56) References Cited

U.S. PATENT DOCUMENTS

| | | | |
|---|---|---|---|
| 4,138,205 | A | 2/1979 | Wallach |
| 4,558,996 | A | 12/1985 | Becker |
| 4,631,008 | A | 12/1986 | Stenner |
| 4,813,855 | A | 3/1989 | Leveen |
| 4,925,376 | A | 5/1990 | Kahler |
| 4,976,590 | A | 12/1990 | Baldwin |
| 5,082,429 | A | 1/1992 | Soderquist |
| 5,388,972 | A | 2/1995 | Calhoun |
| 5,433,588 | A | 7/1995 | Monk et al. |
| 6,019,582 | A | 2/2000 | Green |
| 6,494,692 | B1 | 12/2002 | Green |
| 7,478,999 | B2 | 1/2009 | Limoges |

FOREIGN PATENT DOCUMENTS

| | | | |
|---|---|---|---|
| EP | 0019205 | A1 | 11/1980 |
| EP | 0825345 | A2 | 7/1996 |
| EP | 0731275 | A1 | 11/1996 |
| EP | 0834653 | A2 | 4/1998 |
| EP | 1048848 | A1 | 11/2000 |
| EP | 1291027 | A1 | 8/2002 |

OTHER PUBLICATIONS

Watson-Marlow 300 Series Pumps, Nov. 17, 2005, http://www.watson-marlow.com/watson-marlow/p-300san.htm, Sanitary/300 Series, USA and Canada.

*Primary Examiner* — Karabi Guharay
*Assistant Examiner* — Elmito Breval
(74) *Attorney, Agent, or Firm* — Wood, Herron & Evans, LLP

(57) ABSTRACT

A peristaltic pump is presented comprising a housing and a rotor assembly supported by the housing. An occlusion bed is slideably mounted in the housing. A door is pivotable about a shaft, which is supported by the housing. A pinion gear is coupled to the shaft and engages a rack on the occlusion bed. Rotation of the shaft causes the occlusion bed to slide toward or away from the rotor assembly. An open portion of a tube retaining system is associated with the housing and a clamping portion of the tube retaining system is associated with the door. The open portion and the clamping portion of the tube retaining system are configured to secure flexible tubing therebetween when the door is in a closed position.

15 Claims, 9 Drawing Sheets

PERISTALTIC PUMP

CROSS-REFERENCE TO RELATED APPLICATIONS

This application claims the filing benefit of co-pending U.S. Ser. No. 60/980,951, filed Oct. 18, 2007, the disclosure of which is hereby incorporated herein by reference in its entirety.

FIELD OF THE INVENTION

The present invention relates generally to peristaltic pumps and, more particularly, to a pump that facilitates loading of a fluid carrying tube in the pump.

BACKGROUND OF THE INVENTION

Peristaltic pumps are typically used to pump clean/sterile or aggressive fluids, because cross contamination cannot occur. Some common applications include pumping IV fluids through an infusion device, aggressive chemicals, high solids slurries and other materials where isolation of the product from the environment, and the environment from the product, are critical. The peristaltic pump is the standard method for introducing liquids into the nebulizer on an inductively coupled plasma mass spectrometry (ICP-MS) unit.

Rotary peristaltic pumps typically move liquids through flexible tubing. A typical peristaltic pump has a rotor assembly with pinch rollers that apply pressure to the flexible tubing at spaced locations to provide a squeezing action on the tubing against an occlusion bed. The occlusion of the tubing creates increased pressure ahead of the squeezed area and reduced pressure behind that area, thereby forcing a liquid through the tubing as the rotor assembly moves the pinch rollers along the tubing.

For high pressure peristaltic pumps, where pressures may exceed, for example, approximately 100 psi, very thick, stiff walled tubing is required to accommodate the elevated pressures. This relatively stiff nature of this high pressure tubing poses design challenges for both the loading and occluding operations of the pump.

Accordingly, there is a need for a pump and a tube retaining system that can accommodate the stiffer tubing needed for high pressure applications in both the loading of the tubing into the pump and the occlusion of the tubing during the operation of the pump.

SUMMARY OF THE INVENTION

A peristaltic pump is provided having a housing and a rotor assembly supported by the housing. An occlusion bed is slideably mounted within the housing. A door is pivotable with respect to the housing. A pinion gear is configured to rotate as the door pivots. A rack associated with the occlusion bed engages the pinion gear. Rotation of the pinion gear against the rack causes the occlusion bed to slide toward or away from the rotor assembly.

The peristaltic pump may also include a shaft supported by the housing. The door pivots about the shaft and the pinion gear is coupled to the shaft. Rotation of the shaft causes rotation of the pinion gear. In some embodiments, the peristaltic pump may also include an open portion of a tube retaining system associated with the housing and a clamping portion of the tube retaining system associated with the door. The flexible tubing is able to float in the open portion of the tube retaining system. The open portion and the clamping portion of the tube retaining system are configured to secure flexible tubing therebetween when the door is in a closed position. In an alternate embodiment of the tube retaining system, the open portion of the tube retaining system includes a roller and the clamping portion of the tube retaining system includes a roller. In this embodiment, the roller of the open portion and the roller of the clamping portion allow the clamping portion to pass by the flexible tubing in the open portion and gently squeeze the flexible tubing into a secured position.

Some embodiments of the peristaltic pump include a sensor. The sensor is configured to sense an open door condition and disable the peristaltic pump when the condition is sensed.

A method of loading a peristaltic pump is also provided. The door of the peristaltic pump is opened causing the occlusion bed to slide away from the rotor. The flexible tubing is loaded between the rotor and the occlusion bed. The door of the peristaltic pump is then closed causing the occlusion bed to slide toward the rotor and compress the flexible tubing against the rotor.

In some embodiments, the rotor is oriented in a predetermined rotational position to facilitate loading of flexible tubing. Loading of the flexible tubing may also include placing the flexible tubing in an open portion of a tube retaining system associated with a housing of the peristaltic pump. The flexible tubing is engaged between the open portion of the tube retaining system and a clamping portion of the tube retaining system associated with the door when the door is closed, securing the tubing.

In some embodiments, a recess in the housing of the peristaltic pump is engaged with a ball detent on the door to hold the door in a closed position. An inductive sensor may also be used to sense a position of the door. In response to sensing a door open position, the peristaltic pump is disabled.

In some embodiments, a rack is coupled to the occlusion bed. The rack engages a pinion gear. The pinion gear rotates when the door opens and closes. The rotation of the pinion gear causes the rack to move, sliding the occlusion bed toward or away from the rotor. In some embodiments, the rotor may be replaced prior to loading the flexible tubing to accommodate a change in size of the flexible tubing.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
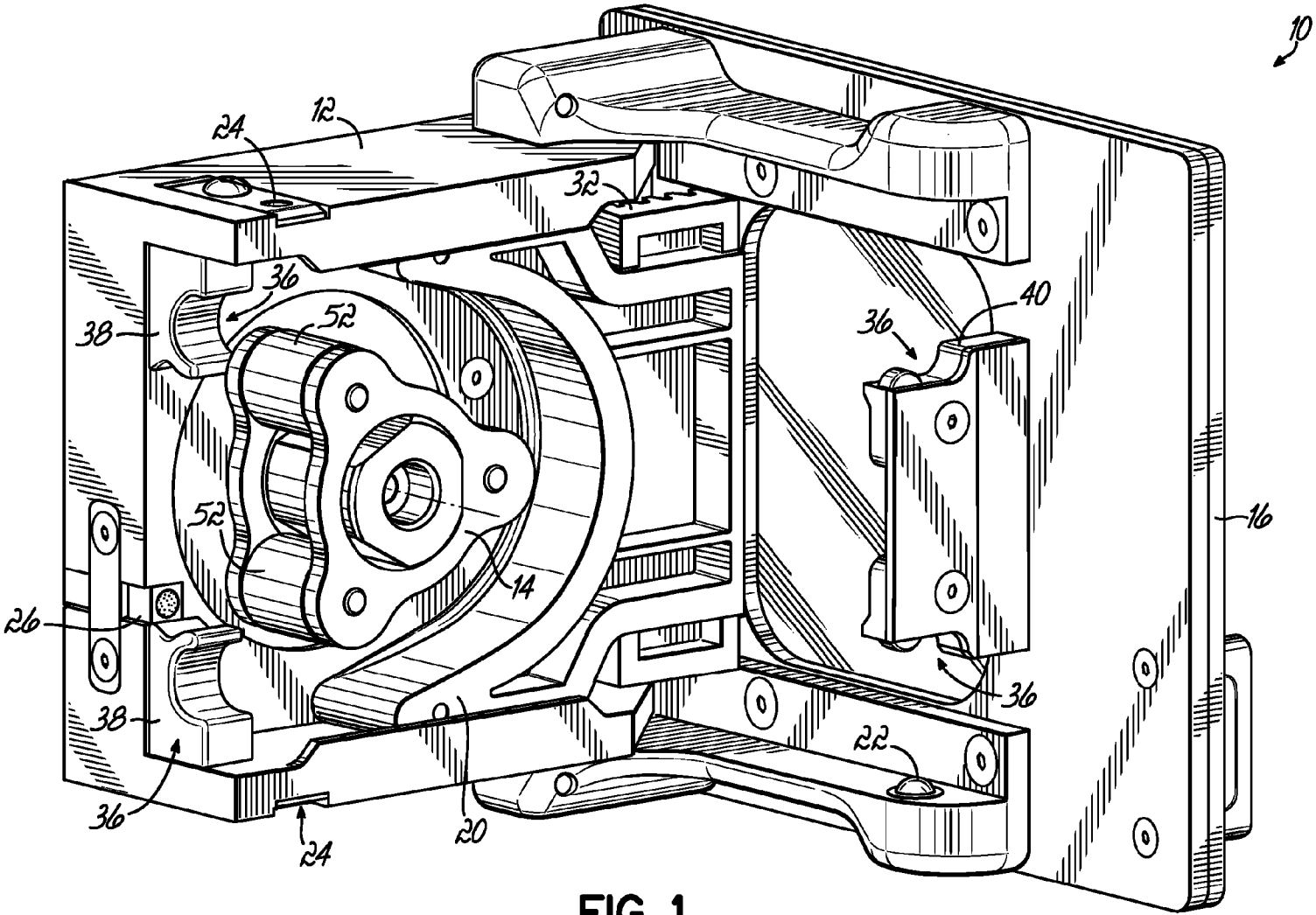
FIG. 1 is a perspective view of an exemplary peristaltic pump consistent with embodiments of the invention with the door in an open position.
Figure 2:
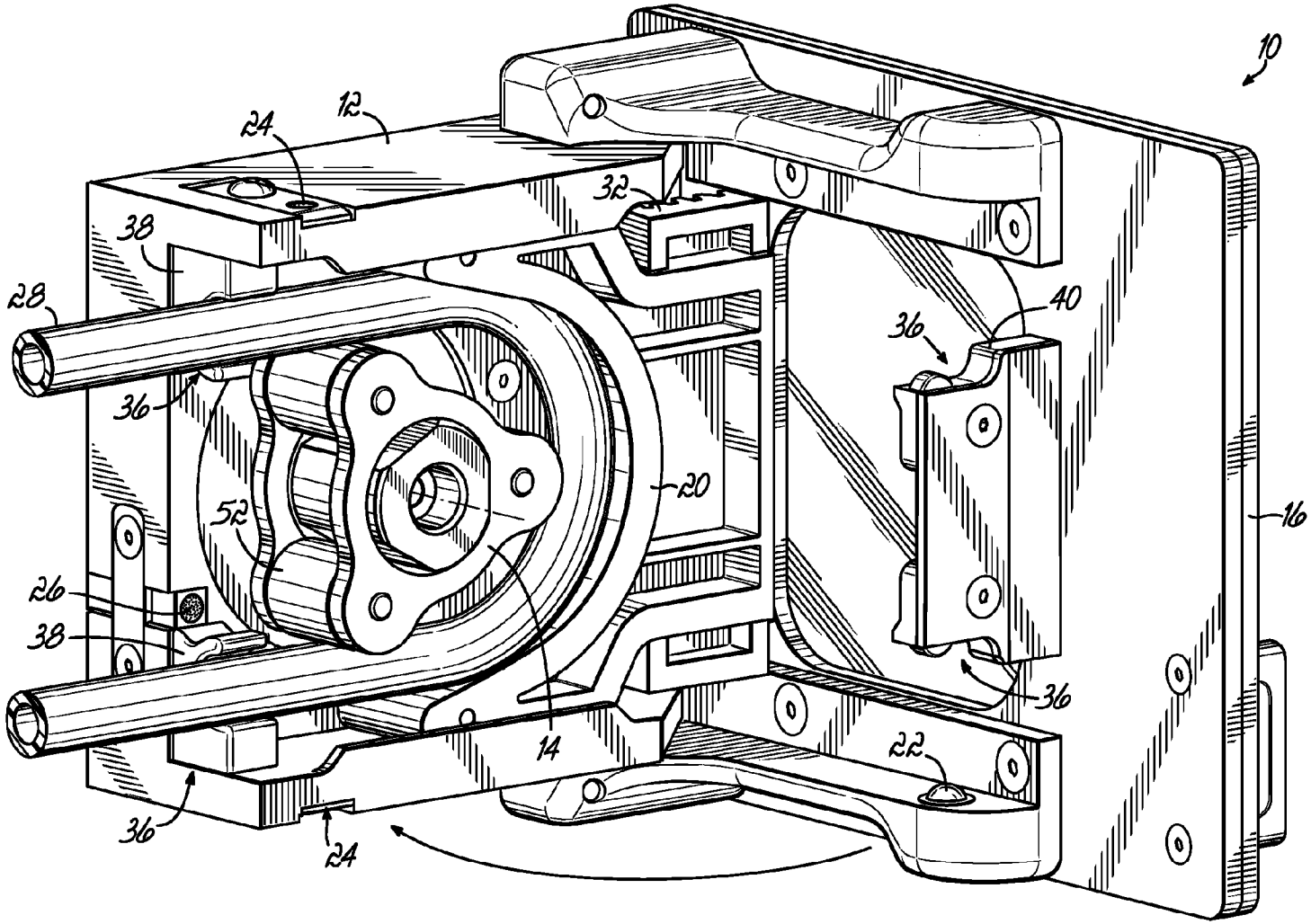
FIG. 2 is a perspective view of the peristaltic pump of FIG. 1 with tubing loaded into the bed.
Figure 3:
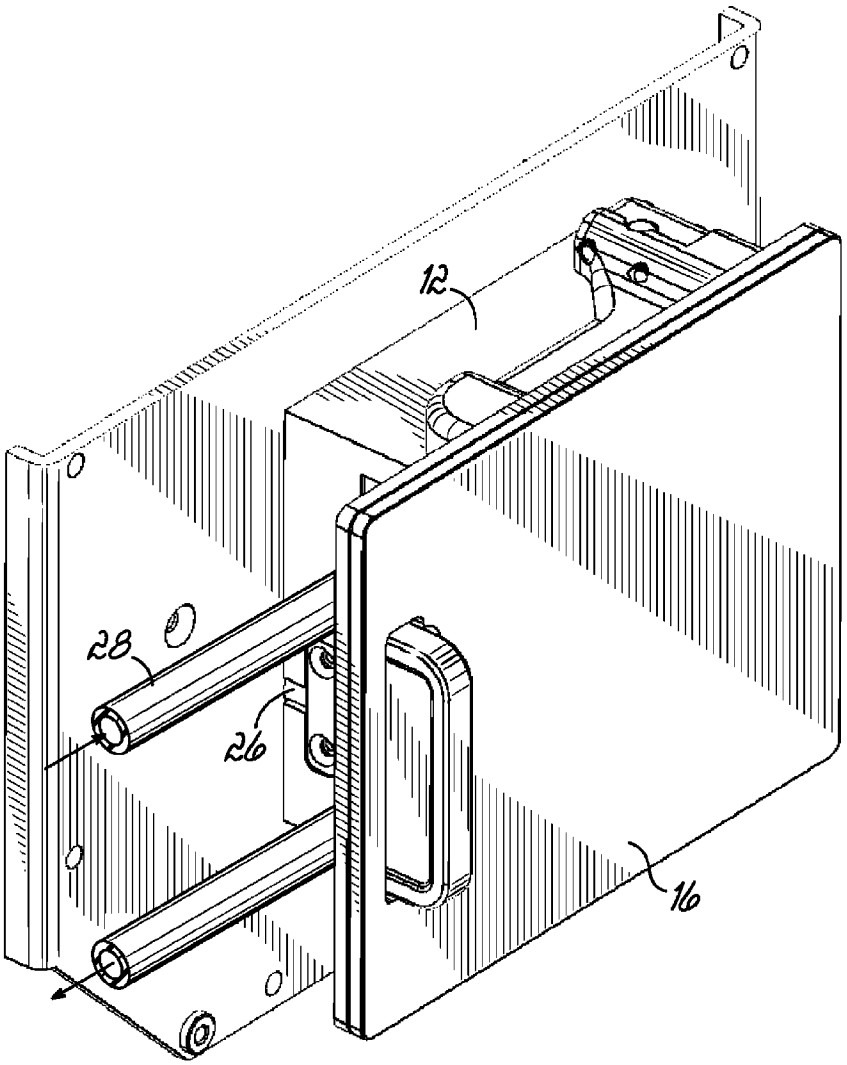
FIG. 3 is a perspective view of the peristaltic pump of FIG. 1 and FIG. 2 with the door in a closed position.
Figure 4A:
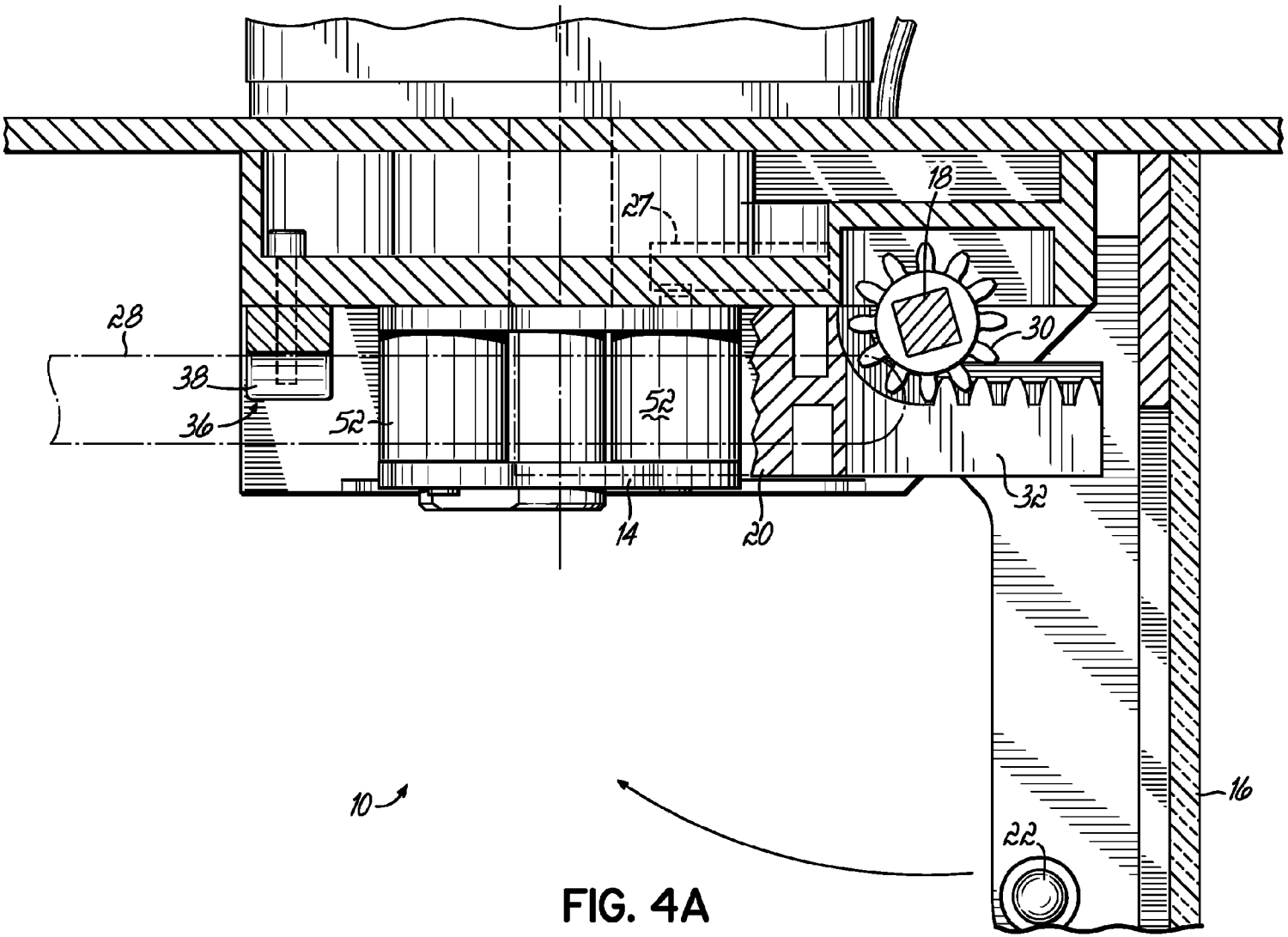
FIGS. 4A-4C are a top cross sectional view of the peristaltic pump of FIGS. 1-3 generally through 4A-4A as the door move from the open position to the closed position.
Figure 5:
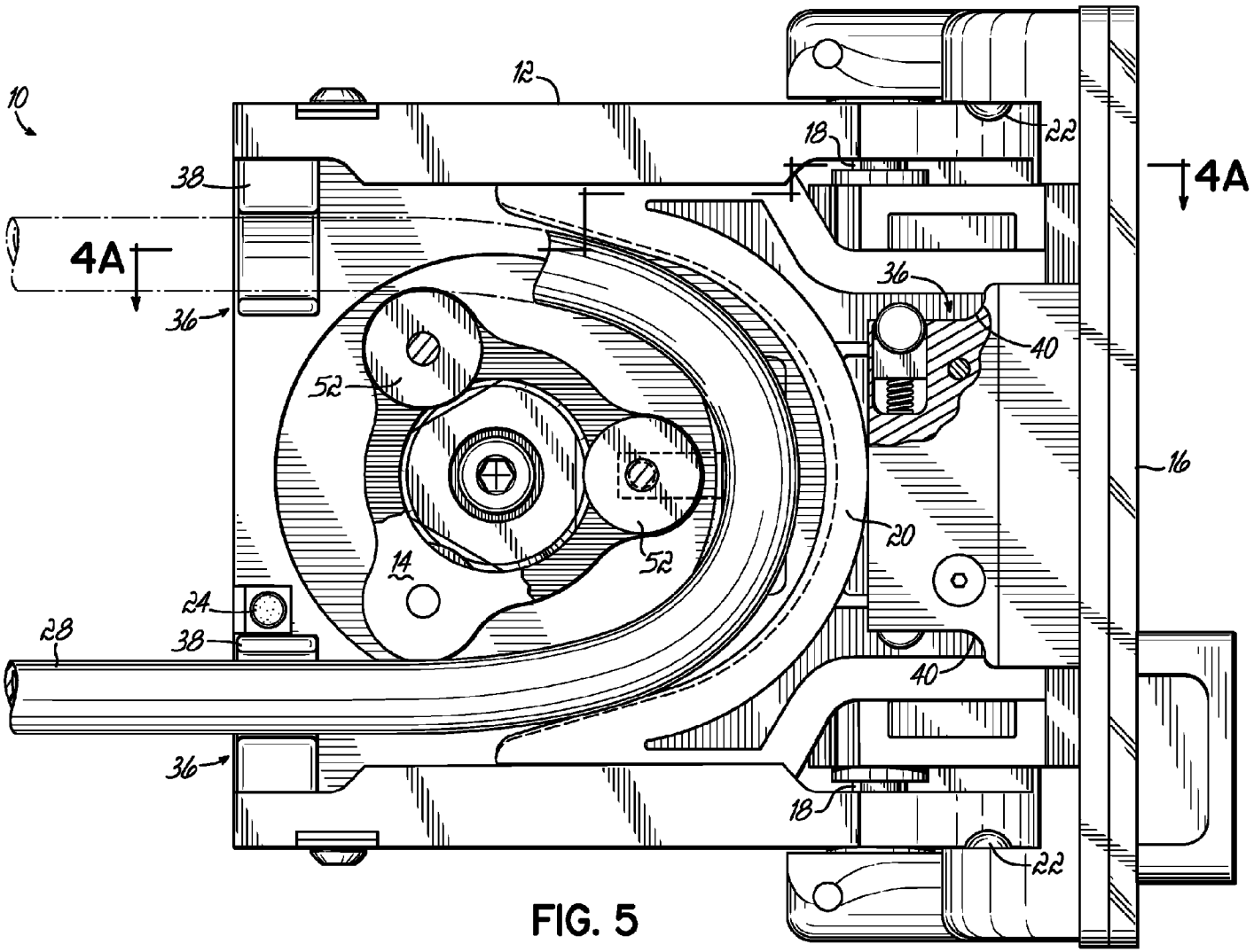
FIG. 5 is a front view of the peristaltic pump of FIG. 1.

Turning to the drawings, wherein like numbers denote like parts throughout the several views, FIGS. 1-3 illustrate a peristaltic pump 10 according to one embodiment of the present invention. The pump 10 includes a housing 12 and a rotor assembly 14 supported by the housing 12. A door 16 pivots about a shaft 18 (FIG. 4A and FIG. 5) allowing the door 16 to open and provide access to the rotor assembly 14 and an occlusion bed 20, for loading and unloading of the pump 10. The ends of the shaft 18 are journaled in the housing 12 as best seen in FIG. 5. The door 16 is secured in a closed position by the use of ball detents 22 that engage recesses 24 associated with the housing 12. In other embodiments, magnets may be used in place of the ball detents 22 and recesses 24 to hold the door in the closed position. Of course, other structures well known to those of ordinary skill in the art for securing the door in a closed position are possible as well. An inductive "door open" sensor 26 may be used in some embodiments to sense an open door condition and disable the unit. While an inductive sensor has been disclosed, one of ordinary skill in the art will recognize that other types of sensors may also be used to sense the open condition of the door.

Figure 4B:
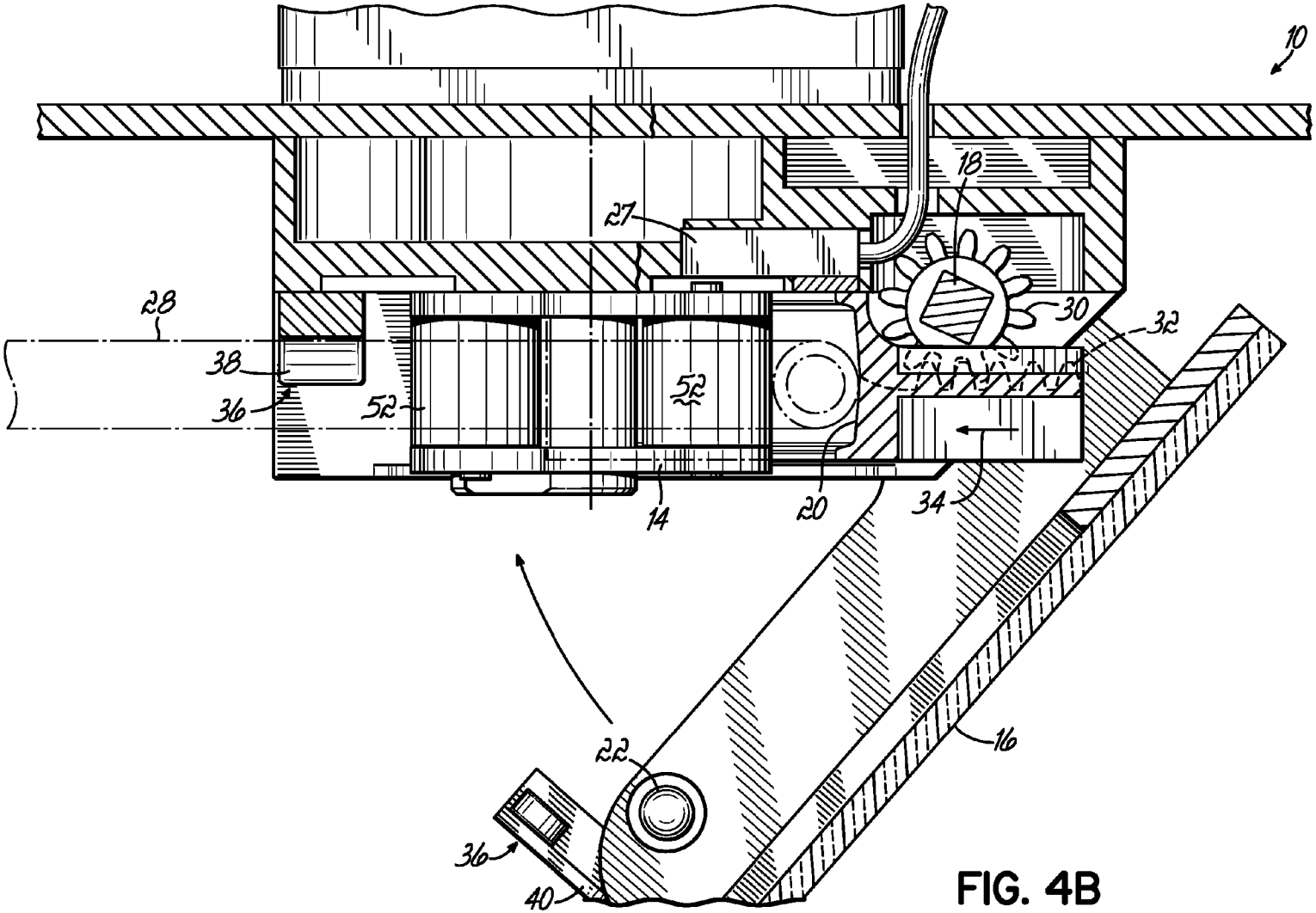
Figure 4C:
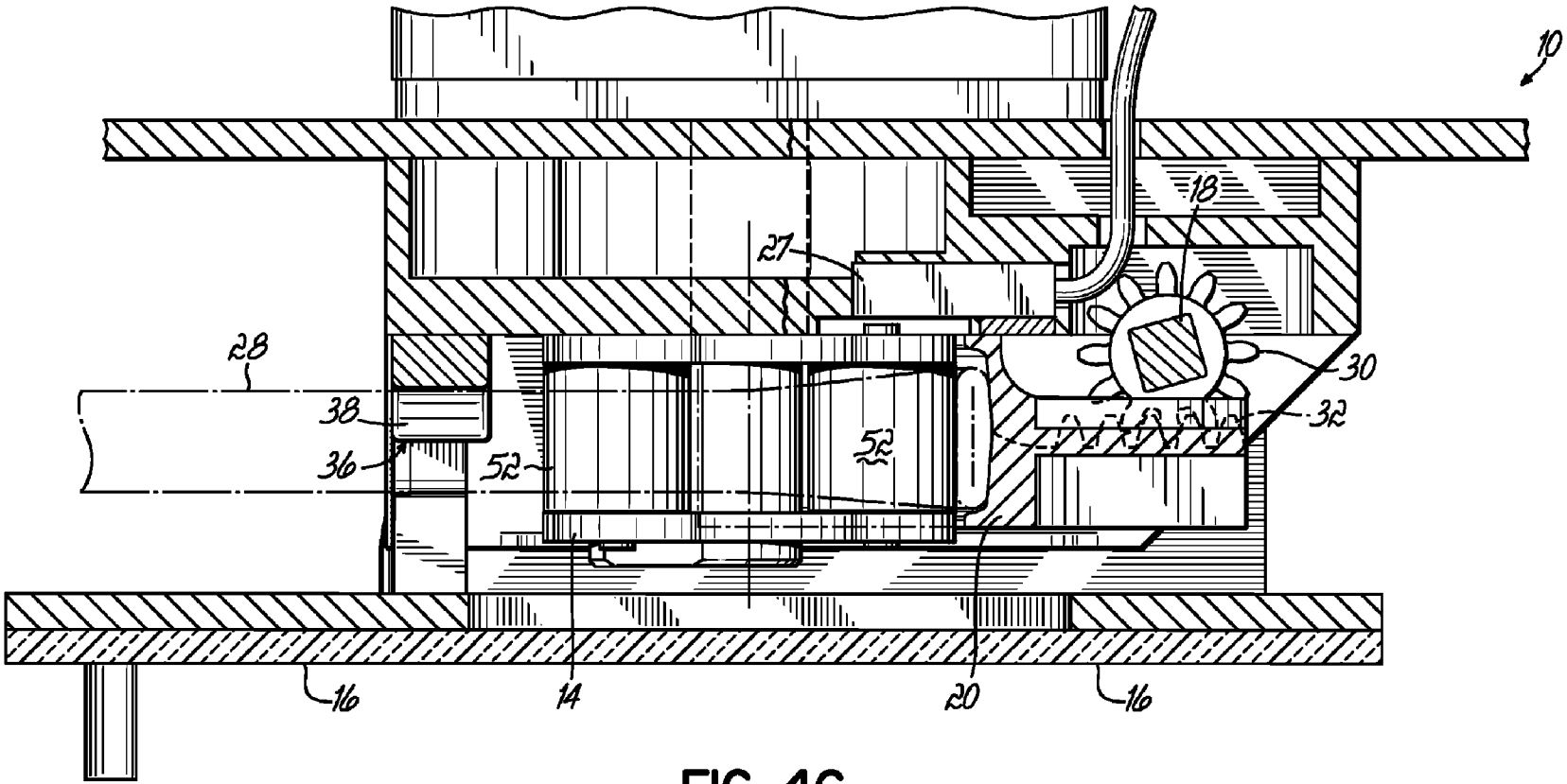

When the door 16 is opened, power is supplied, or the pump 10 is halted, a rotor sensor 27 orients the rotor assembly 14 to a predetermined rotational position, such as shown in FIG. 5 for example, in order to facilitate loading and unloading of flexible tubing 28 into and out of the pump 10. Additionally, in one embodiment, the occlusion bed 20 is slideably mounted in the housing 12 allowing it to move relative to the rotor assembly 14. As illustrated in FIGS. 4A-4C, to facilitate the movement of the occlusion bed 20, a pinion gear 30 is coupled to the shaft 18. The pinion 30 mates with a rack 32 associated with the occlusion bed 20. As the door 16 opens and closes, the shaft 18 rotates, thus rotating the pinion 30, which causes linear movement 34 of the rack 32.

The rack 32 and pinion 30 are configured such that as the door closes, the linear movement 34 of the rack 32 causes the occlusion bed 20 to move toward the rotor assembly 14. With the door 16 in the open position (FIG. 4A) the occlusion bed 20 is at its furthest distance from the rotor assembly 14 facilitating the loading and unloading of the pump 10. As the door 16 closes, the linear movement 34 first causes the flexible tubing 28 to initially contact the rotor assembly 14 and occlusion bed (FIG. 4B) and finally compress the flexible tubing 28 between the rotor assembly 14 and the occlusion bed 20 in the final position when the door 16 is fully closed (FIG. 4C). In other embodiments, multiple pinions 30 may be coupled to the shaft 18 and mate with multiple racks 32 associated with the occlusion bed 20. In some embodiments, the rack 32 may be integral with the occlusion bed 20. In still other embodiments, the rack 32 may be coupled to the occlusion bed 20. It will be appreciated by those of ordinary skill in the art that other structures for moving the occlusion bed 20 relative to the rotor assembly 14 are possible as well without departing from the scope of the present invention.

Figure 6:
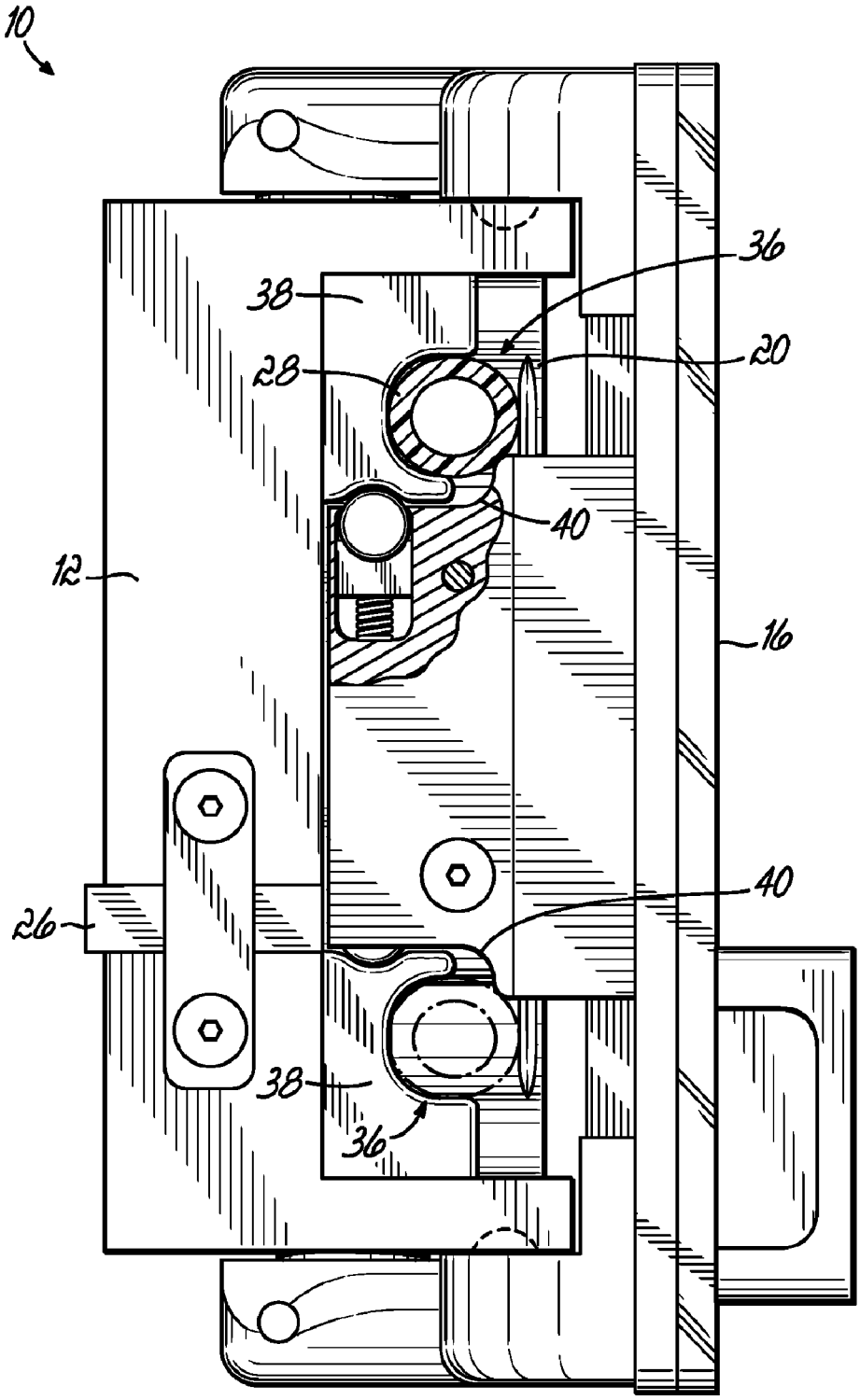
FIG. 6 is a side view of the peristaltic pump of FIG. 3.

As seen in FIG. 2 and FIG. 5, in order to load flexible tubing 28 into the pump 10, the door 16 is opened, and as described above, the rotor assembly 14 is oriented in a predetermined rotational position while the occlusion bed 20 moves away from the rotor assembly 14. The tubing 28 is placed between the rotor assembly 14 and the occlusion bed 20. A tube retention clamping system 36 is associated with the door 16 as seen in FIGS. 1 and 6. With the door 16 remaining open, the tubing 28 is then pressed into an open portion 38 of the tube retaining system 36. In this state, the tubing 28 is allowed to float in the open portion retainers 38. As the door 16 is closed, as set forth above with respect to FIGS. 4A-4C, the occlusion bed 20 moves toward the rotor assembly 14, pushing the tubing 28 toward the rotor assembly 14. This is possible because the tubing 28 floats in the open portion of the retainer 38. In the final stages of closing the door 16, the occlusion bed 20 compresses the tubing 28 against the rotor assembly 14. As this occurs, a retention clamping portion 40 associated with the door 16, gently wedges the tubing 28 into a secured position as the tubing 28 is pushed against the open portion 38 and pinched by the clamping portion 40, as best seen in FIG. 6. In some embodiments, an additional external latch may be employed to ensure the door 16 remains closed. This method does not require a user of the pump 10 to pull on the tubing 28 to eliminate slack in the tubing 28 as may be necessary with other prior pump designs. Nor does this method require an extra mechanism to stretch the tubing 28 as may also be necessary with some prior pump designs.

Figure 7:
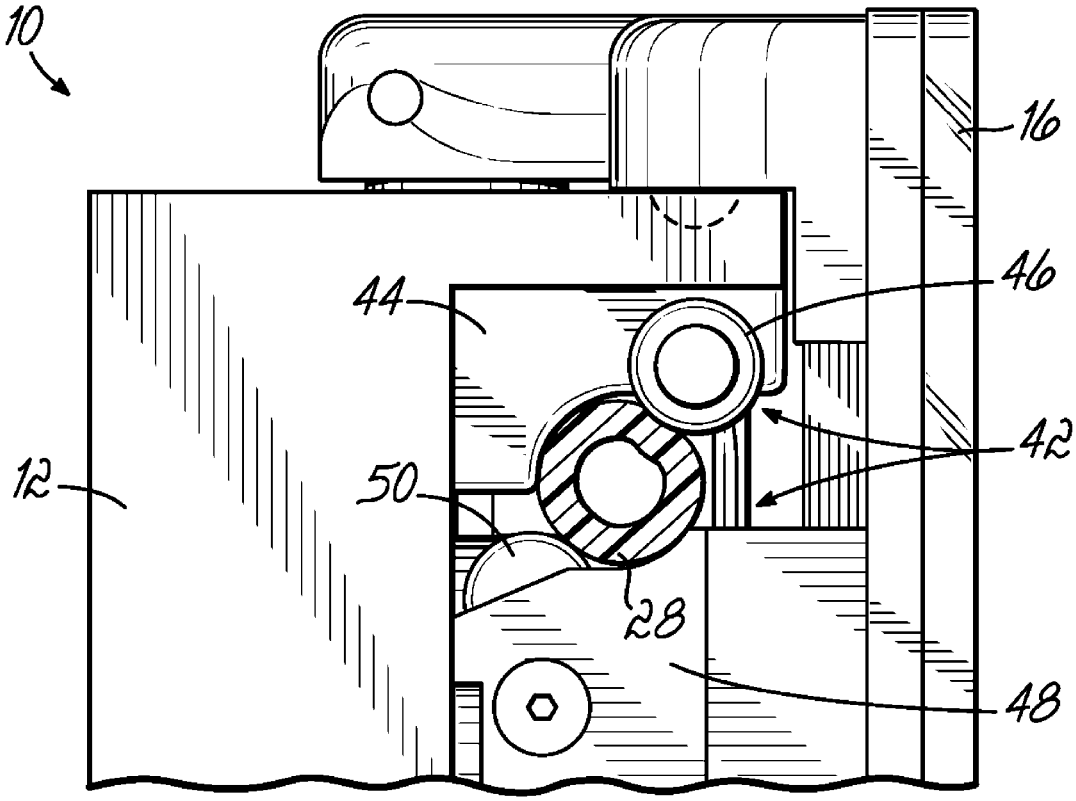
FIG. 7 is a detailed view an alternate embodiment of the peristaltic pump of FIG. 6.

FIG. 7 shows an alternate configuration of the tube retention and clamping system 42. In this embodiment, the open portion of the tube retainers 44 employs a roller 46. Similarly, the retention clamping portion 48 also employs a roller 50. The rollers 46, 50 allow the retention clamping portion 48 to pass by the tubing 28 in the open retainer 44 and gently squeeze the tubing 28 into a secured position when the door 16 is completely closed as best seen in FIG. 7. In still other embodiments, the retainer system may include interchangeable wedges to accommodate different sizes of tubing 28.

Leverage supplied by the door 16 through the rack 32 and pinion 30 allows a user of the pump 10 to easily occlude the stiff tubing 28 required for high pressure applications. As described above, this arrangement also allows the door 16 to remain in a closed position with a simple latch mechanism, such as the ball detents 22 and recesses 24. Additionally, the rack 32 and pinion 30 design allows for a more precise occlusion tolerance, allowing the occlusion to be set to the proper position prior to door 16 being closed. Once the proper occlusion distance is achieved the door 16 is moved to the closed position to assure the occlusion location during operation. Then the tube retention and clamping systems 36 or 42 are engaged with the door 16 in the closed position to retain the proper occlusion position during operation and to slide the occlusion bed 20 back when the door 16 is open. This configuration may accommodate tubing 28 of different diameters that have similar wall thicknesses. The rotor assembly 14 and/or rollers 52 may be changed out to accommodate tubing 28 having thicker or thinner walls.

Because the retainer system is built into the door 16 closing operation, embodiments of the pump 10 may be easier to use. Many prior art pumps require the user to load the tubing, secure or latch the tubing, close the door, and then latch the door. Embodiments of the pump 10 have the user of the pump 10 simply load the tubing 28 then close the door 16, thus eliminating steps during loading.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A peristaltic pump comprising:

a housing;

a rotor assembly supported by the housing;

an occlusion bed slideably mounted in the housing;

a door pivotable with respect to the housing;

a pinion gear configured to rotate as the door pivots; and a rack associated with the occlusion bed engaging the pinion gear, wherein rotation of the pinion gear against the rack causes the occlusion bed to slide toward or away from the rotor assembly.

2. The peristaltic pump of claim 1, further comprising:

a shaft supported by the housing, wherein the door pivots about the shaft, and further wherein the pinion gear is coupled to the shaft and rotation of the shaft causes rotation of the pinion gear.

3. The peristaltic pump of claim 1, further comprising:

an open portion of a tube retaining system associated with the housing; and a clamping portion of the tube retaining system associated with the door, wherein the open portion and the clamping portion of the tube retaining system are configured to secure flexible tubing therebetween when the door is in a closed position.

4. The peristaltic pump of claim 3, wherein flexible tubing is able to float in the open portion of the tube retaining system.

5. The peristaltic pump of claim 3, wherein the open portion of the tube retaining system comprises a roller.

6. The peristaltic pump of claim 5, wherein the clamping portion of the tube retaining system comprises a roller.

7. The peristaltic pump of claim 6, wherein the roller of the open portion and the roller of the clamping portion allow the clamping portion to pass by the flexible tubing in the open portion and gently squeeze the flexible tubing into a secured position.

8. The peristaltic pump of claim 1, further comprising:

a sensor, wherein the sensor is configured to sense an open door condition and disable the peristaltic pump when the condition is sensed.

9. A method of loading a flexible tubing into a peristaltic pump comprising: opening a door of the peristaltic pump causing an occlusion bed to slide in a linear direction away from a rotor; loading the flexible tubing between the rotor and the occlusion bed; and closing the door of the peristaltic pump causing the occlusion bed to slide in a linear direction toward the rotor and compressing the flexible tubing against the rotor.

10. The method of claim 9, further comprising:

orienting the rotor in a predetermined rotational position to facilitate loading of the flexible tubing.

11. The method of claim 9, further comprising:

placing the flexible tubing in an open portion of a tube retaining system associated with a housing of the peristaltic pump; and engaging the flexible tubing between the open portion of the tube retaining system and a clamping portion of the tube retaining system associated with the door when the door is closed to secure the tubing.

12. The method of claim 9, further comprising:

engaging a recess in a housing of the peristaltic pump with a ball detent on the door to hold the door in a closed position.

13. The method of claim 9, further comprising:

sensing a position of the door with an inductive sensor; and in response to sensing a door open position, disabling the peristaltic pump.

14. The method of claim 9, further comprising:

coupling a rack to the occlusion bed;

engaging the rack with a pinion gear; and rotating the pinion gear when the door opens and closes, wherein the rotation of the pinion gear causes the rack to move, sliding the occlusion bed toward or away from the rotor.

15. The method of claim 9, further comprising:

replacing the rotor prior to loading the flexible tubing to accommodate a change in size of the flexible tubing.

* * * * *